US005755137A

United States Patent [19]

Tomida

[11] Patent Number: 5,755,137

[45] Date of Patent: May 26, 1998

[54] ENGINE STARTER MOUNTING STRUCTURE

[75] Inventor: Yoshiharu Tomida, Chiryu, Japan

[73] Assignee: Nippondenso Co., Ltd., Kariya, Japan

[21] Appl. No.: 680,933

[22] Filed: Jul. 16, 1996

[30] Foreign Application Priority Data

Jul. 17, 1995 [JP] Japan ..... 7-180378
Jun. 5, 1996 [JP] Japan ..... 8-143043

[51] Int. Cl.[6] ..... F02N 15/06

[52] U.S. Cl. ..... 74/7 E; 74/7 A; 123/179.25

[58] Field of Search ..... 74/6, 7 R, 7 A, 74/7 E; 123/179, 25, 195 A

[56] References Cited

U.S. PATENT DOCUMENTS 1,175,326 3/1916 Wilson ..... 74/7 E X
1,605,090 11/1926 Bijur ..... 74/7 E X
1,640,753 8/1927 Chryst ..... 123/179.25
4,155,266 5/1979 Bradley ..... 74/6
5,163,335 11/1992 Isom et al. ..... 74/6
5,207,195 5/1993 McClintic ..... 123/179.25

FOREIGN PATENT DOCUMENTS 575105 12/1993 European Pat. Off. .
2631094 11/1989 France .
5-149220 6/1993 Japan .

*Primary Examiner*—Allan D. Herrmann
*Attorney, Agent, or Firm*—Cushman, Darby & Cushman IP Group of Pillsbury, Madison & Sutro LLP

[57] ABSTRACT

A starter includes a pinion supported in a housing rotatably and engageably with a ring gear fitted to a crankshaft, and a starter motor fixed to the housing and having a rotary shaft for driving the pinion through a speed reduction mechanism. The starter is mounted on an engine block in such a manner that an axis center of the motor is located closer to the axis center of the ring gear than an axis center of the pinion. This starter mounting structure reduces the rotary vibrations of the starter motor.

7 Claims, 3 Drawing Sheets

ENGINE STARTER MOUNTING STRUCTURE

BACKGROUND OF THE INVENTION

1. Field of the Invention

The present invention relates to an engine starter mounting structure and, more particularly, to a mounting structure of a starter on an engine which reduces vibrations of a starter motor due to engine vibrations.

2. Description of Related Art

Vehicle engines are cranked generally by starters (engine starting device) The starter has a motor, speed reduction mechanism and a pinion so that the torque generated by the motor is increased by the speed reduction mechanism to be transmitted to a crankshaft through the pinion and a ring gear.

Such a conventional engine starting device is mounted on the engine as shown in FIG. 5.

A pinion housing 3 which encases the pinion 2 therein engageably with a ring gear 5 (flywheel) of the engine and a starter motor 4 which drives the pinion 2 through the speed reduction mechanism are located at a lateral side (right side in FIG. 5) of the crankshaft 11 of the engine 1. The pinion housing 3 is fixed to a block 12 or a flywheel housing (not shown) of the engine 1 by a bracket (not shown) or the like. For protecting the starter motor 4 from heat, the starter motor 4 is normally located away from the block 12 of the engine 1. In this mounting structure, a rotary axis center 40 of the starter motor 4 is dislocated more from a rotary axis center 10 of the crankshaft 11 than a rotary axis center 20 of the pinion 2 is.

According to the conventional mounting structure, reliability of the starter motor operation is degraded by the vibrations transmitted from the engine to the starter motor 4, particularly to bearings and a commutator of the motor.

SUMMARY OF THE INVENTION

It is an object of the present invention to improve an engine starter mounting structure.

It is another object of the present invention to reduce vibrations of a starter motor and enhance operational reliability of the starter motor.

The present invention is based on the consideration that the engine vibration vector is primarily a composite of the linear vibration vector component due to reciprocating motion of engine pistons and the rotary vibration vector component due to crankshaft rotation, and the rotary vibration vector component exerts particularly in a circumferential direction around an engine crankshaft. That is, since the pistons reciprocate through alternation of the combustion stroke (crankshaft acceleration period) and the compression stroke (crankshaft deceleration period), the crankshaft torque responsively fluctuates periodically. The rotary vibration vector component arises from the rotary vibrations of an engine block which turns reversely as the reaction to the periodical fluctuations in the crankshaft torque.

In more detail, a maximum magnitude W of the rotary vibrations at a location away from the crankshaft of the engine block by a distance r is expressed as $W=r\times\theta max$, with $\theta max$ being a maximum deflection angle. It is thus understood that this rotary vibration and also the engine block rotary vibration which resonates with the rotary vibration vector component increase as the distance r from the crankshaft rotary axis center.

According to the present invention, therefore, a starter is so mounted on an engine that a rotary axis center of a starter motor is located closer to a crankshaft rotary axis center than a pinion is. That is, the distance of the starter motor rotary axis center to the crankshaft rotary axis center is more shortened than in the abovedescribed conventional starter mounting structure or in another mounting structure in which a starter has a coaxially arranged pinion rotary shaft and starter motor rotary shaft. Thus, as understood from the foregoing expression, starter motor vibrations can be reduced and its durability can be improved.

Preferably, the outer diameter of the starter motor is made smaller than the outer diameter of a portion of a casing encasing therein a rotary force transmitting member, the portion being coaxially disposed with the pinion. Thus, when the starter is mounted on the engine as closely as possible to an engine block, the starter motor rotary axis center can be located closer to the crankshaft rotary axis center than the pinion rotary axis center is, as long as there exists a space for locating the casing behind a position for locating the pinion when viewed axially or in a direction the crankshaft extends along. In addition, the starter motor can be located entirely within outer confines of the casing when viewed axially or in a direction the pinion extends along. That is, since the starter motor can be located without being protruded radially outside the outer confines of the casing, freedom in mounting the starter on the engine is enhanced remarkably and consequently other auxiliary equipment of the engine can be mounted in a space provided radially outside the starter motor when viewed from the engine side.

Preferably, the starter is provided with a speed reduction mechanism, as a rotary force transmitting member, for transmitting the starter motor rotation to the pinion. The speed reduction mechanism increases the rotary torque to be transmitted to the pinion while reducing the rotary speed. With this construction, a compact, high speed motor can be used for the starter motor and the motor rotary axis center can be located more closely to the ring gear rotary axis center than the pinion rotary axis center. Thus, not only the starter motor vibrations can be reduced further but also mountability of other engine auxiliary equipment in a space opposite to the engine with respect to the starter motor.

BRIEF DESCRIPTION OF THE DRAWINGS

Other features and advantages of the present invention will become more apparent from the following detailed description when read in conjunction with the accompanying drawings, in which.

DETAILED DESCRIPTION OF PREFERRED EMBODIMENTS

Figure 1:
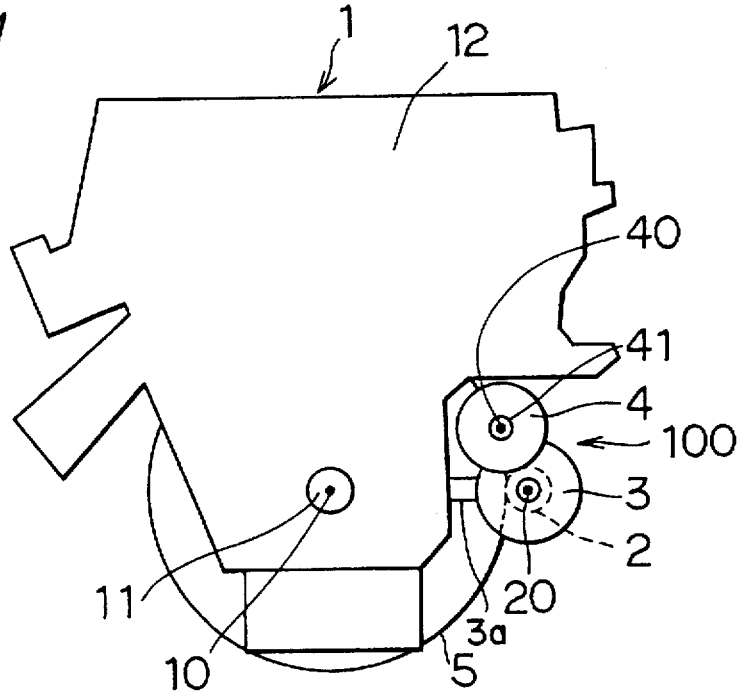
FIG. 1 is a schematic front view showing a starter mounting structure according to a first embodiment of the present invention.

The present invention will be described in detail with reference to the embodiments shown in the accompanying drawings. It is to be noted that the same reference numerals are used to designate the same of similar parts throughout embodiments for simplification of explanation.

(FIRST EMBODIMENT)

Figure 2:
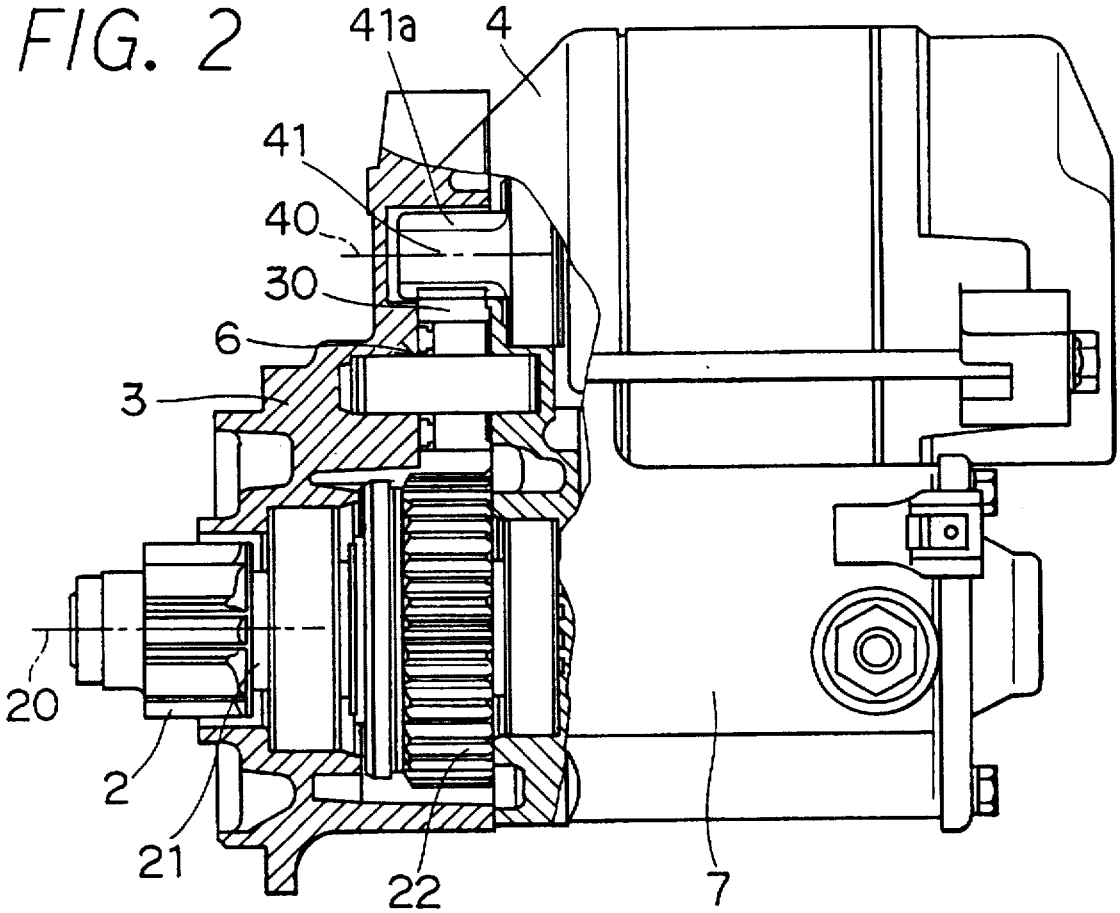
FIG. 2 is a side view showing, partly in cross section, a starter used in the first embodiment of FIG. 1.

An engine starter 100 is mounted, as shown in FIG. 1, on a V-type engine 1 which has an engine block 12 with a laterally large upper portion and a laterally small lower portion. A crankshaft 11 coupled with a flywheel having a ring gear 5 is rotatably supported at the lower portion. The starter 100 is mounted at a lateral or radial outside location of the lower portion of the engine block 12 (right side in the figure). The starter 100 has a pinion housing 3 supporting a pinion rotatably therein for engagement with the ring gear 5, and a starter motor 4 for driving the pinion 2 through a speed reduction mechanism 6 (FIG. 2). The pinion housing 3 is fixedly attached to the engine block 12 or a flywheel housing (by a bracket 3*a*) by a bracket (not shown) in the conventional manner, while the starter motor is tightened to the pinion housing 3.

According to this embodiment, the rotary axis center 40 of an output shaft (armature shaft) 41 of starter 4 is located more closely to the rotary axis center 10 of the crankshaft 11 than the rotary axis center 20 of the pinion 2. The motor rotary axis center 40 and the pinion rotary axis center 20 are also located radially outside the outer periphery of the ring gear 5.

As shown in FIG. 2 in detail, the speed reduction mechanism 6 comprises a gear portion 41*a* formed the axial end of the motor output shaft 41, a pinion gear 22 formed on the pinion output shaft 21, and an idle gear 30 engaged with the gear portion 41*a* and the pinion gear 22. A magnet switch 7 is placed axially behind the pinion gear 22 on the pinion rotary axis center 20 and below the starter motor 4. The motor rotary axis center 40 and the pinion rotary axis center 20 are arranged in parallel to each other and also to the crankshaft rotary axis center 10.

With this construction, upon energization by a battery (not shown) for engine cranking, the magnet switch 7 advances the pinion 2 for engagement with the ring gear 5 and energizes the starter motor 4, which in turn rotates the motor output shaft 41. This rotation rotates the pinion 2 in a reduced speed through the speed reduction mechanism 6. The pinion rotation is further decelerated in speed by the ring gear 5 to rotate the crankshaft 11 so that the engine 1 is started.

Thus, since the motor rotary axis center 40 is located closer to the crankshaft rotary axis center 10, the motor vibrations can be reduced. Further, since the starter 100 can be mounted beside the lower portion of the engine block 12 and below the upper portion of the engine block 12 without protruding laterally outside the confines of the upper portion of the engine block 12 when viewed from the top of the engine 1, it is effective to reduce the overall size of the engine 1 with the starter 100.

Although in the first embodiment the speed reduction mechanism 6 is so constructed as to transmit the rotation of the starter motor 4 to the pinion 2 in reduced speed, such a mechanism need not reduce the rotation speed and may be constructed by a simple rotation transmitting member such as a gear wheel or a belt as long as the motor axis 40 and the pinion axis 20 are arranged in parallel.

(SECOND EMBODIMENT)

Figure 3:
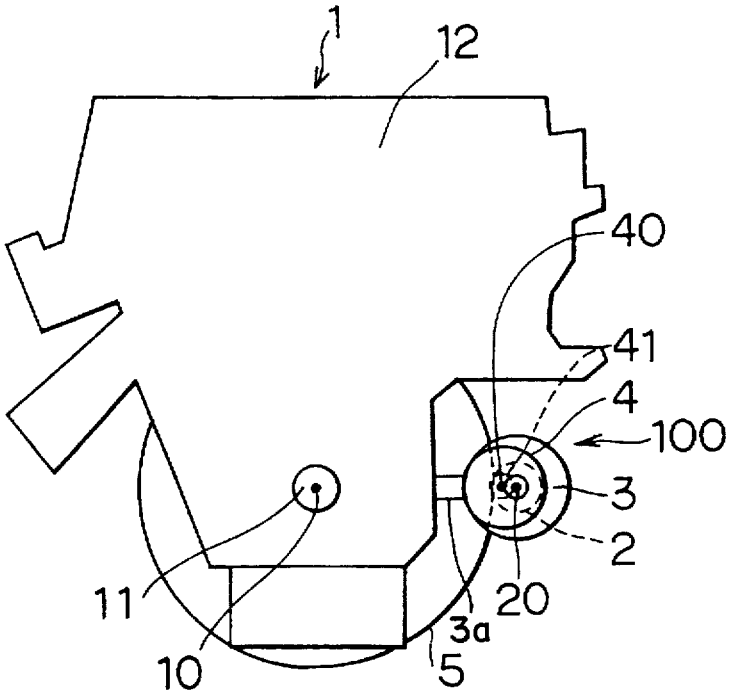
FIG. 3 is a schematic front view showing a starter mounting structure according to a second embodiment of the present invention.
Figure 5:
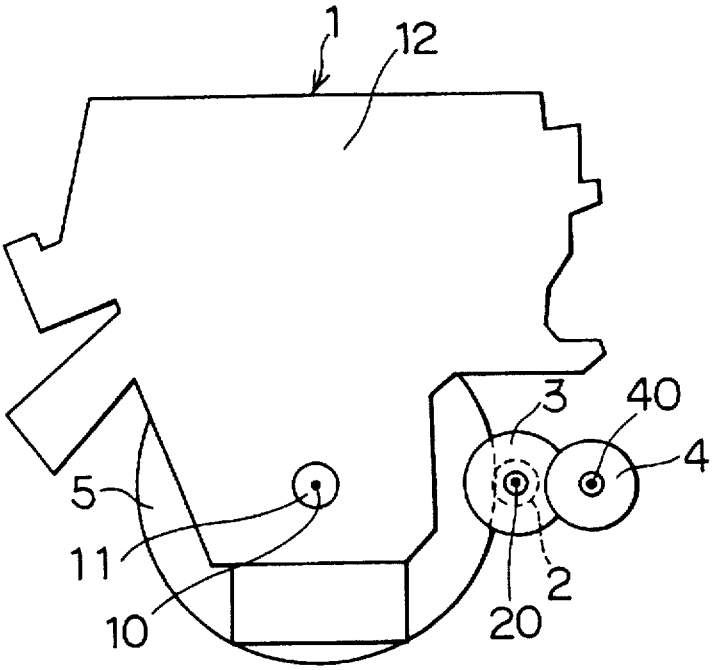
FIG. 5 PRIOR ART
FIG. 5 is a front view showing a conventional starter mounting construction.
Figure 4:
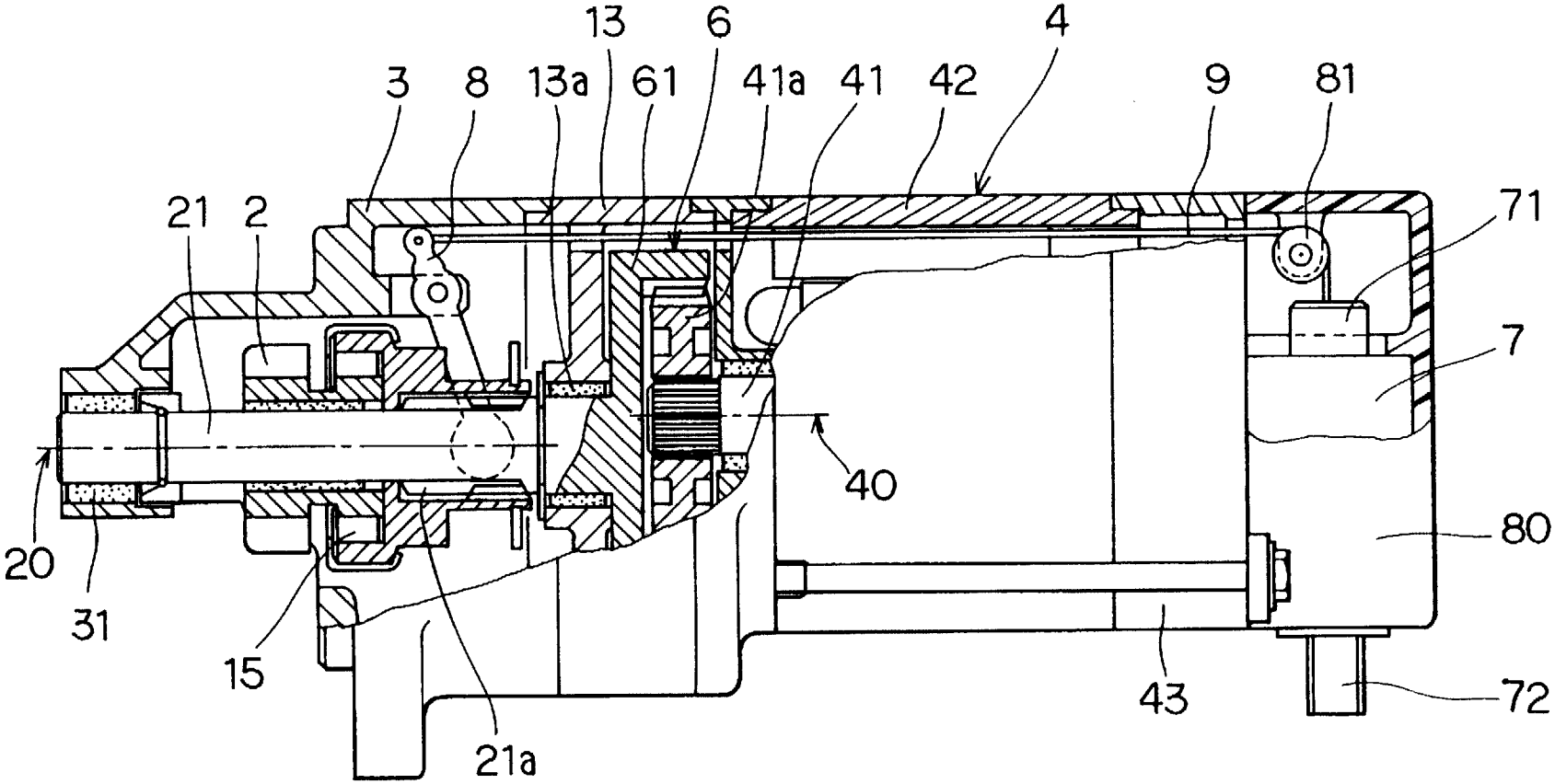
FIG. 4 is a side view showing, partly in cross section, a starter used in the second embodiment of FIG. 2.

In a second embodiment shown in FIGS. 3 and 4, a starter 100 is constructed differently from the first embodiment. As shown in FIG. 4, a starter 100 has a pinion housing 3 encasing a pinion 2 therein, a starter motor 4 for driving the pinion 2 through a speed reduction mechanism 6, a center case 13 encasing the speed reduction gear 6 therein, and a magnet switch 7 disposed at the rear end (right side in the figure) of the starter motor 4 for controlling energization of the starter motor 4 and movement of the pinion 2.

An output shaft 41 of the starter motor 4 and a pinion output shaft 21 are coupled through a rotary force transmitting member comprising a speed reduction mechanism 6. The speed reduction mechanism 6 is constructed by a gear portion 41*a* formed at the axial end of motor output shaft 41 and an internal gear wheel 61 formed on the pinion output shaft 21. The internal gear wheel 61 is supported rotatably within the center case (casing) 13. The starter motor 4 and the pinion housing 3 are fastened tightly to each other by bolts (not shown), sandwiching the center case therebetween.

The pinion output shaft 21 is supported rotatably by the pinion housing 3 through a bearing 31 at the front end side (left side in the figure) thereof, and supported rotatably by the center case 13 through a bearing 13*a* at the rear end side thereof, i.e., at the portion just in front of the internal gear wheel 61. A helical spline 21*a* is formed on a part of the outer circumference of the pinion output shaft 21, and the pinion 2 is fitted on the pinion output shaft 21 through a one-way clutch 15 to slide axially thereon. Thus, The rotation of the pinion output shaft 21 is transmitted to the pinion 2.

The outer diameter of the starter motor 4 is determined to be smaller than the outermost diameter of a portion of the center case 13 encasing the internal gear wheel 61. That is, the lowermost portion of the center case 13 protrudes more radially downwardly than that of the starter motor 4, while the uppermost portions of the two are kept flush to each other. Thus, the axis center 20 is not coaxial with the axis center 40 but positioned lower. With this construction, the starter 100 is mounted on the engine 1 as shown in FIG. 3 in which the axis center 40 of the starter motor 4 is located more closely to the axis center 10 of the crankshaft 11 than the axis center 20 of the pinion 2. The motor rotary axis center 40 and the pinion rotary axis center 20 are also located radially outside the outer periphery of the ring gear 5.

The magnet switch 7 is disposed at the rear end of the starter motor 4, more specifically, at the further rear side of an end frame 43 of the starter motor 4, in a condition encased within a switch cover 80 made of an insulating material such as resin. A battery terminal 72 which is connectable to a vehicle-mounted battery (not shown) is provided at the underside of the switch cover 80.

In addition, the starter 100 is so constructed that, when the magnet switch 7 is energized for engine cranking, the operation (downward movement) of a plunger 71 of the magnet switch 7 is transmitted to a cord-like connecting member 9, converted in force transmission direction by a pulley 81 provided in the switch cover 80, and transmitted within a yoke 42 of the starter motor 4 to a lever 8 which in turn moves the pinion 2 for engagement of the ring gear 5.

According to the second embodiment, the starter motor 4 is arranged within the outer radial confines of the center case 13 when viewed in the axial direction of the pinion output shaft 21, and further the axis center 40 of the starter motor 4 is located more closely to the axis center 10 of the ring gear 5 than the axis center 20 of the pinion output shaft 21 is. Therefore, the vibrations of the starter motor 4 resulting from engine rotary vibrations can be reduced and, when the starter 100 is mounted on the engine 1, both center case 13 and starter motor 4 can be located closely to the engine 1.

This results in the advantage that an extra space can be provided laterally outside the starter motor 4 for arranging other engine auxiliary equipment, thus improving the mountability of such other equipment therein.

Although in the second embodiment the magnet switch 7 is disposed at the axial rear end of the starter motor 4 so that the starter motor 4 and its rear-side configuration are entirely hidden within the outermost confines of the center case 13 when viewed axially from the front side of the pinion 2, the mountability of the starter 100 can be improved as well by only mounting the magnet switch 7 which is generally smaller in radial size than the starter motor 4 on one circumferential side (opposite side to the engine block 12, i.e., lower side in FIG. 4) of the starter motor 4 in parallel to the starter motor 4.

Further, although the terminal bolt 72 is provided on the side where the starter motor 4 is reduced in radial size than the center case 13, i.e., on the side laterally remote from the engine 1, it may be provided at any other locations than around the portion laterally closest to the engine 1 without degrading the mountability of the starter 100 on the engine 1 in view of the fact that there exists not so much strong relation between the position of the battery terminal 72 and the direction of displacement of the starter motor 4 (axis center 40) from the center case 13 (axis center 20).

The present invention should not be understood restrictively to the foregoing embodiments but should be understood to include other modifications which can be made without departing from the spirit of the invention.

What is claimed is:

1. An engine starter mounting structure comprising:

an engine having a crankshaft and a ring gear rotated by the crankshaft;

a housing fixed to the engine;

a pinion supported in the housing rotatably along a pinion rotary shaft and engagably with the ring gear;

a starter motor attached to the housing and having a motor rotary shaft extending generally in parallel to the pinion rotary shaft, the starter motor producing a rotary force around the motor rotary shaft; and a rotary force transmitting member disposed for transmitting the rotary force from the starter motor to the pinion, wherein an axis center of the motor rotary shaft is located closer to an axis center of the ring gear than an axis center of the pinion rotary shaft and wherein the motor rotary axis center and the pinion rotary axis center are located radially outside an outer periphery of the ring gear.

2. An engine starter mounting structure according to claim 1, further comprising:

a casing encasing the rotary force transmitting member therein and having a portion coaxial with the pinion, wherein the starter motor has a smaller diameter than that of the coaxial portion of the casing.

3. An engine starter mounting structure according to claim 1, wherein:

the rotary force transmitting member includes a speed reduction mechanism for transmitting the rotary force from the starter motor to the pinion in a reduced speed.

4. An engine starter mounting structure according to claim 2, wherein:

the rotary force transmitting member includes a speed reduction mechanism for transmitting the rotary force from the starter motor to the pinion in a reduced speed.

5. An engine starter mounting structure according to claim 2, wherein:

the casing is disposed axially between the housing and the starter motor; and outer circumferential surfaces of the coaxial portion of the casing and the starter motor are being flush to each other at a side closer to the engine.

6. An engine starter mounting structure according to claim 5, further comprising:

a magnet switch disposed axially adjacent to the starter motor at a position behind the pinion with respect to the starter motor; and a terminal bolt provided on another circumferential side of the starter motor different from the flush circumferential surface.

7. An engine starter mounting structure according to claim 1, further comprising:

a magnet switch disposed axially behind the pinion on the pinion rotary axis center to advance the pinion into engagement with the ring gear.

* * * * *